US010820646B2

(12) United States Patent
Allen

(10) Patent No.: US 10,820,646 B2
(45) Date of Patent: Nov. 3, 2020

(54) SYSTEM AND METHOD FOR IMPEDING THE DISPLACEMENT OF CLOTHING

(71) Applicant: Sheldon Allen, Maple Valley, WA (US)

(72) Inventor: Sheldon Allen, Maple Valley, WA (US)

( * ) Notice: Subject to any disclaimer, the term of this patent is extended or adjusted under 35 U.S.C. 154(b) by 214 days.

(21) Appl. No.: 15/831,165

(22) Filed: Dec. 4, 2017

(65) Prior Publication Data

US 2018/0213870 A1 Aug. 2, 2018

Related U.S. Application Data

(60) Provisional application No. 62/453,242, filed on Feb. 1, 2017.

(51) Int. Cl.

| | |
|---|---|
| ***A41F 19/00*** | (2006.01) |
| ***A41D 27/02*** | (2006.01) |
| ***A41F 17/00*** | (2006.01) |
| *A41F 5/00* | (2006.01) |
| *A63C 7/02* | (2006.01) |

(52) U.S. Cl.

CPC ..... *A41F 19/00* (2013.01); *A41D 27/02* (2013.01); *A41F 17/00* (2013.01); *A41B 2400/80* (2013.01); *A41D 2400/80* (2013.01); *A41F 5/00* (2013.01); *A63C 7/02* (2013.01)

(58) Field of Classification Search

CPC ..... A41F 19/00; A41F 17/00; A41D 27/02

See application file for complete search history.

(56) References Cited

U.S. PATENT DOCUMENTS

| | | | | |
|---|---|---|---|---|
| 1,811,843 | A * | 6/1931 | Chisholm | D03D 15/10 139/421 |
| 2,390,462 | A * | 12/1945 | Rosenberg | A41D 13/0005 2/70 |
| 2,619,651 | A * | 12/1952 | Leoanrd | 2/320 |
| 2,697,230 | A * | 12/1954 | Rosecrans, Sr. | A41F 11/16 2/308 |
| 3,253,599 | A * | 5/1966 | Bjorn-Larsen | A41B 11/128 450/104 |
| 3,478,478 | A * | 11/1969 | Luebs | E06B 3/58 52/309.1 |
| 3,496,944 | A * | 2/1970 | Cuozzi | A41B 11/126 450/104 |
| 3,854,978 | A * | 12/1974 | Campbell, Sr. | A41F 9/00 427/375 |
| 5,343,564 | A * | 9/1994 | Reynolds | A41D 13/001 2/236 |
| 5,867,836 | A * | 2/1999 | Quinones | A41F 9/02 2/221 |

(Continued)

*Primary Examiner* — Gloria M Hale

(74) *Attorney, Agent, or Firm* — Christopher Mayle; Thomas E. LaGrandeur; Bold IP, PLLC

(57) ABSTRACT

An improved system and method for keeping articles of clothing properly fixed in place. Embodiments include a first article of clothing and a second article of clothing. Embodiments further include having one or more climbing skin fabrics having a plurality of fibers affixed to a first article of clothing. The one or more climbing skin fabrics having the plurality of fibers allow movement of the second article of clothing in one direction with respect to the first article of clothing while impeding movement of the second article of clothing in the other unwanted direction.

19 Claims, 7 Drawing Sheets

(56) References Cited

U.S. PATENT DOCUMENTS

| | | | | |
|---|---|---|---|---|
| 8,176,864 | B2 * | 5/2012 | Angelino | A41D 27/245 112/440 |
| 8,990,965 | B2 * | 3/2015 | Waldman | A41D 27/02 2/69 |
| 9,596,897 | B2 * | 3/2017 | Huff | A41F 9/02 |
| 2006/0010559 | A1 * | 1/2006 | Hamlet | A41B 1/08 2/117 |
| 2010/0186149 | A1 * | 7/2010 | Miller | A41F 9/00 2/337 |
| 2010/0229284 | A1 * | 9/2010 | Wilson, II | A41D 1/08 2/237 |
| 2012/0210495 | A1 * | 8/2012 | Wilson | A41D 1/08 2/236 |
| 2014/0044910 | A1 * | 2/2014 | Shi | |
| 2015/0040285 | A1 * | 2/2015 | Mobayyen | A41F 17/00 2/70 |

* cited by examiner

SYSTEM AND METHOD FOR IMPEDING THE DISPLACEMENT OF CLOTHING

CROSS-REFERENCE TO RELATED APPLICATIONS

The present application is a non-provisional application which claims the benefit of U.S. Provisional Patent Application No. 62/453,242, filed on Feb. 1, 2017, entitled "SYSTEM AND METHOD FOR IMPEDING THE DISPLACEMENT OF CLOTHING;" which is incorporated herein by reference in its entirety as if fully set forth herein.

TECHNICAL FIELD

The overall field of the invention is clothing. More particularly, the subject matter relates to a system and method for keeping articles of clothing appropriately arranged with respect to one another while wearing said clothes.

BACKGROUND

Choosing what to wear is one of the most important decisions people have to make on a daily basis. Whether someone is trying to impress a first date, interviewing for a dream job, participating in a sporting event, or preparing for a blizzard, clothing selection can be a very strenuous process. People end up spending vast amounts of time trying on clothes in front of a mirror and when they finally do get everything exactly the way they want it can be ruined in a matter of minutes. Shirts become untucked, dresses ride up, sleeves roll in, and even underwear (e.g. undershirts and/or bras) are exposed. Now the big day planned and prepped for is already off to a bad start. Everyday activities can have dire effects on the way outfits are arranged and end up changing the appearance of the outfit to the dismay of the wearer. Because of this, countless people have put in time and effort devoted to solving this problem.

A number of patents have been filed that are directed to maintaining clothes in their desired arrangement. U.S. Pat. No. 2,114,222 (Holben) discloses the use of rubber grip surfaces adjacent to the inside waistline of a pair of pants that prevent a shirt from being untucked. The rubber grips hold the shirt in place but if the shirt is dislodged the shirt cannot easily be put back into the pants with the rubber grips now preventing movement in the opposite direction.

U.S. Patent App. Pub. No. 2006/0010559 (Hamlet) discloses a self-tucking shirt mechanism that utilizes a strip of fabric with fibers extending outwardly that are uniformly angled to keep the shirt tucked into the pants. The fibers require a complicated process to be manufactured and have to be angled in a specific way that can be distorted or warped over time, losing their effect.

U.S. Pat. No. 5,276,923 (Cohen) discloses a device with a harness arrangement having concave sides to accommodate a user's groin area with numerous tethers extending from the harness arrangement, each with fasteners that connect the harness arrangement to the user's shirt, preventing the shirt from moving upward. This device has numerous parts that can be cumbersome, expensive, and that are easily broken.

U.S. Pat. No. 6,175,993 (Gilman) discloses a shirt-locking device that is comprised of a fastening device and a weight. The fastening device affixes to the bottom part of a shirt in a tucked position down and against an undergarment.

This device requires multiple parts and only works when the direction the user wants the clothes held is in the same direction of gravity.

U.S. Patent App. Pub. No. 2010/0235969 (Issacson) discloses an undergarment that includes a body and elongated loops that have fasteners, which attach to the body and to the bottom of a shirt to keep the shirt in place. This system has numerous parts that can become detached or are easily broken.

U.S. Pat. No. 6,3973,393 (Alger) discloses a clothing combination comprised of a shirt and pants that are fastened together by a self-releasing bond composed of a series of hook and loop strips. This invention requires multiple parts and is advantageous in only certain circumstances such as intense athletic endeavors because the clothing fasteners take a while to be connected and cannot be separated very easily.

U.S. Pat. No. 8,769,780 (Segel) discloses a device that includes three magnetic components with cords connected to each component where clothes are kept in place by being in the middle of the magnetic attraction of the components. This invention requires multiple parts and the magnetic parts can be troublesome if outside forces attract the magnets or electronic devices are in proximity.

U.S. Pat. No. 1,519,878 (Goldstein) discloses the use of a specially made fabric comprised of superposed layers with hairline projections that attaches to the inside of the pants and prevent the shirt from moving upwards. This fabric is intricately designed and needs to be manufactured by a certain method that can prove costly.

All of the current solutions suffer from one or more of the problems described above. Thus, there is still a great need for an improved system and method for impeding the displacement of clothing.

SUMMARY

In one aspect, embodiments are provided in the present description related to system for impeding the displacement of clothing. In one embodiment, the system includes a first article of clothing and a second article of clothing. The system may further include one or more sections of climbing skin fabrics, whereby the one or more sections of climbing skin fabrics have a plurality of fibers disposed on an outer surface of the one or more sections of climbing skin fabrics. Further, the plurality of fibers may have a particular orientation selected to oppose unwanted movement in a particular direction, whereby the one or more sections of climbing skin fabrics are configured to affix to the first article of clothing. Further, the second article of clothing is configured to be in contact with the plurality of fibers of the one or more sections of climbing skin fabrics affixed to the first article of clothing.

In another aspect, embodiments provided in the present description are directed to a method for impeding a displacement of clothing of a first article of clothing with respect to a second article of clothing. The method may include, in one or more embodiments, affixing the first article of clothing with one or more pieces of climbing skin fabrics, whereby the one or more sections of the climbing skin fabrics have a plurality of fibers on an outer surface of the one or more sections of the climbing skin fabrics. Further, the plurality of fibers may have a particular orientation that is biased in an opposite direction from an unwanted movement of the second article of clothing with respect to the first article of clothing. The method may include positioning the second article of clothing in a desired position with respect to the first article of clothing on a wearer's body such that the second article of clothing is in contact with the one or more sections of the climbing skin fabrics affixed to the first article of clothing. Further, the method may include that the second article of clothing is met with a higher coefficient of friction while moving in a direction against the particular orientation of the plurality of fibers and a lower coefficient of friction while moving in a same direction as the particular orientation of the plurality of fibers, thereby securing the first article of clothing and second article in place as well as facilitating movement of the second article of clothing back in place.

The foregoing summary is illustrative only and not intended to be in any way limiting. Other aspects and advantages of the invention will be apparent from the following description and the appended claims.

BRIEF DESCRIPTION OF DRAWINGS

Some embodiments of this invention herein have been described and illustrated with reference to the embodiments of FIGS. 1-6, but it should be understood that the features and operation of the one or more embodiments provided in the present description are susceptible to modification and alteration without departing significantly from the scope or spirit thereof. For example, the dimensions, size and shape of the various elements may be altered to fit specific applications. Accordingly, the specific embodiments illustrated and described herein are for illustrative purposes.

DETAILED DESCRIPTION

Figure 1:
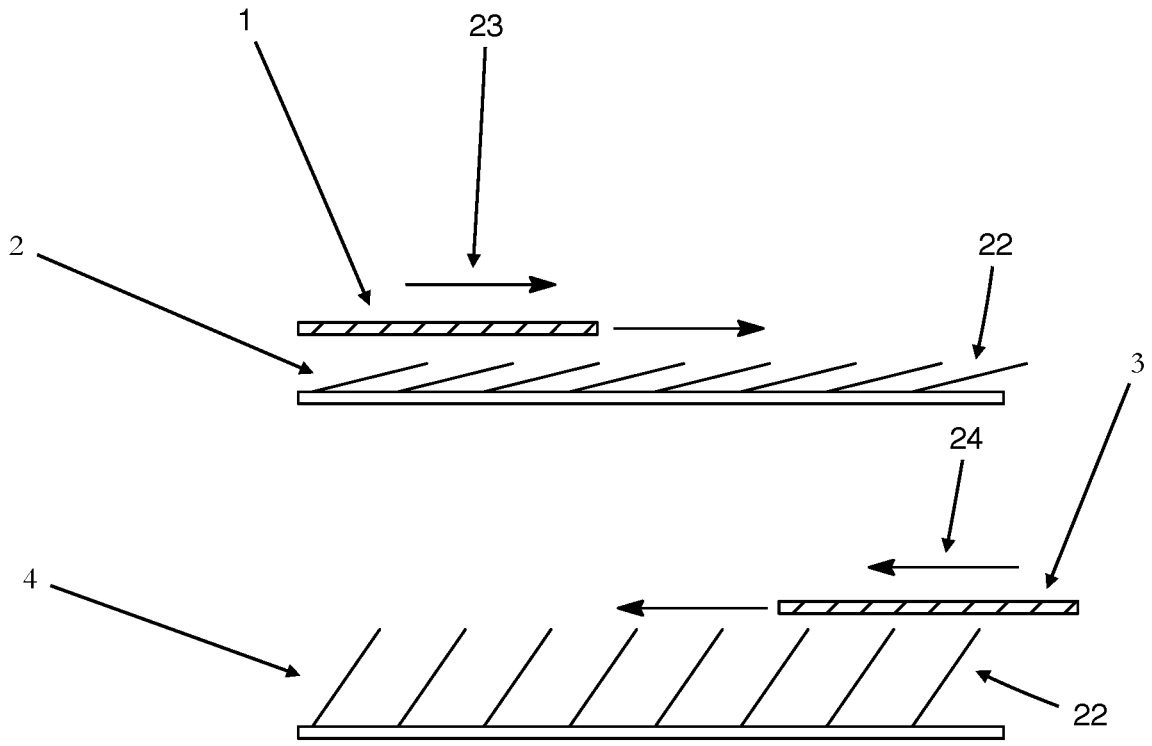
FIG. 1 is a pictorial illustration of an exemplary climbing skin fabric in operation with an object in accordance with an embodiment of the present description.

It is to be understood that the disclosure of the invention in this specification includes all possible combinations of such features. For example, where a feature is disclosed in the context of a aspect or embodiment of the invention, or a claim, that feature can also be used—to the extent possible—in combination with and/or in the context of other aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limits include both numbers. For example, "25 to 100" means a range whose lower limit is 25 and upper limit is 100, and includes both 25 and 100.

Embodiments are provided in the present description that may beneficially provide a simpler and more convenient system and method for keeping articles of clothing in place during use without the need for multiple components or devices such as straps, magnets, suspenders, and connectors. The embodiments provided in the present description may use material fabric that is attachable to the clothing of a wearer such that when the clothing is moved out of place or dislodged, the wearer is able to quickly and easily adjust the clothing back into place and not experience difficulty in doing so because of the material, which is the problem with many convention mechanisms used to keep clothing in place. The embodiments of the present description provide a number of additional advantages. For example, the embodiments of the system in the present description do not require fibers of the fabric or material used to attach to the clothing to keep the clothing in place to be fixed at a certain angle or woven into a specific overlapping arrangement.

Accordingly, the present description includes embodiments for a system and method to keep articles of clothing in place that utilizes fabric having fibers that normally lie flat. Notably, when clothes become engaged with or move into contact with the fiber of the fabric (according to one or more non-limiting embodiments), the fibers can either grip the clothing or the clothing can glide past the fibers based on the direction of the fibers.

One or more embodiments for a system for impeding the displacement of clothing, as described herein, incorporates fabric that is often used for climbing skins. Climbing skins are known in the art as strips of fabric that attach to skis to help the skiers (including skiing athletes) ascend backcountry slopes. Climbing skins may be attachable to the bottom of the skis by adhesive or other attachment means. Climbing skins are made from fibers that stop skis from sliding backwards downwards when the skis are being used to ascend a sloped incline. Advantageously, the fibers of the climbing skin provide low friction and cause the skier to glide on the ice when the direction of movement (e.g. upwards or downwards) of the skis is the same as the direction of the fibers on the climbing skins. Conversely, when the skis are moving in a direction against the direction of the fibers of the climbing skins, the fibers provide high friction for the user and the skis are able to better grip the surface of the ice.

The present description includes a novel system and method for using the climbing skin in the form of fabrics having climbing skins as shown in the drawings and as described herein. By affixing sections of climbing skin fabrics to a first article of clothing, a second article of clothing can be held in place if the second article of clothing comes into contact against the direction of the fibers. Also, the wearer of the clothing is able to push the second article of clothing in place as originally arranged. Further, when the wearer needs to adjust or fix the placement of an article of clothing that has moved out of place, the fibers of the climbing skin fabrics allow the article of clothing to slide past the climbing skin in the direction of the fibers of the climbing skins. Further details for the one or more embodiments of the present description are provided below with reference to each of the attached drawings.

Turning to FIG. 1, FIG. 1 is a pictorial illustration of a climbing skin coupled to an object, such as object 1 and object 3. FIG. 1 is a high-level illustration that depicts generally, for illustrative purposes and without restriction thereto, how a climbing skin fabric, such as climbing skin fabrics 2 and 4, may function when attached to an object (e.g. objects 1 and 3), and the properties of the fibers 22 that may be located on climbing skin fabrics 2 and 4. In some embodiments, the fibers 22 can exhibit low friction (e.g. have a low coefficient of friction) when an object, such as object 1, comes in contact with the fibers 22 and the object 1 is moving in the same direction (e.g. as indicated by arrow 23 in FIG. 1) of the fibers 22, which can also be described as object 1 gliding or sliding over climbing skin fabric 2.

On the other hand, when an object, such as object 3 comes in contact with the fibers 22 of climbing skin 4, and object 3 is moving in the opposite direction (e.g. as indicated by arrow 24 in FIG. 1) of the fibers 22 of object 3, the fibers 22 may exhibit high friction (e.g. have a high coefficient of friction), which means the movement of object 3 is impeded (i.e. restricted, halted, and/or prevented) when moving in the direction of arrow 24. Additionally, even if object 3 is stationary, the fibers 22 of climbing skin 4 is also able to better grip against a surface of object 3. Thus, FIG. 1 shows generally how climbing skin fabric 2 may offer ease of movement if an object, such as object 1, is sliding in the same direction (see arrow 23 in FIG. 1) as the fibers 22 of climbing skin fabric 2. Further, FIG. 1 shows generally how climbing skin fabric 4 (which is the equivalent in every way to climbing skin fabric 2) may impede or inhibit the movement of an object if an object, such as object 3, is sliding or moving in the opposite direction (see arrow 24 in FIG. 1) as the fibers 22 of climbing skin fabric 4.

In one or more embodiments, fibers 22 on climbing skin fabrics 2 and 4 may made of mohair, nylon, or may be a combination thereof (e.g. a nylon-mohair mixture) but other types of fibers may alternatively be utilized. Nylon fibers may provide a very strong gripping capability, are the most durable, and may require the least maintenance in comparison to other fibers. Mohair fibers may offer the best glide, but also may wear out somewhat faster than nylon and have less ability to grip. Nylon and mohair mixture fibers have better glide than pure nylon skins and a little more grip and durability than pure mohair skins. Mohair fibers or a mixture of predominately mohair fibers may be more suitable for normal, everyday or moderate activity garments whereas nylon or a mixture of predominately nylon fibers may be more suitable for more vigorous activity garments. However, those of ordinary skill in the art will appreciate that any type of fibers may be used as desired and the above-description is not intended to characterize or limit any of the embodiments that may be developed to impede the displacement of clothing.

As used herein, climbing skin fabrics, such as climbing skin fabrics 2 and 4, may be affixed to any type of clothing or garment including any type of clothing or garments for men, women, adults, or children. Examples of such clothing or garments may include, but is not limited to, pants, shirts, blouses, jackets, cardigans, dresses, skirts, and/or underwear. Further, climbing skin fabrics, such as climbing skin fabrics 2 and 4 may also be used on pet clothing as well in some embodiments.

Further, it has been described above that the climbing skin fabrics may be used to adhere clothing selected for vigorous activity. Vigorous activity may include, but is not limited to, manual labor jobs and activities, physical exercise of any kind, sporting activities, or the like. When people are about to engage in vigorous activity (e.g. sports, exercise, and/or manual labor of any sort), they tend to wear clothes that are suitable for such activity and may be easily cleaned or are replaceable or the owner does not mind if the garments become soiled or absorb sweat. Many professions involve a great deal of physical labor and activity, and it may be particularly useful for such professions to use the climbing skin fabrics, according to one or more embodiments described herein, to help keep such garments in place. For example, and without limitation thereto, climbing skin fabrics, according to one or more embodiments, may be particularly helpful for nurses, construction workers, teachers, police officers, repairmen, and/or any other individual while engaging in any type of vigorous activity, whether for work related reasons or for any other reason.

It is noted that climbing skin fabrics, such as climbing skin fabrics 2 and 4, may be formed having any width or length selected to suit the specific type of article of clothing and/or intended activity. Nevertheless, the following may be taken into consideration when determining an appropriate or suitable width or length for the climbing skin fabrics. The width of the fabrics, such as climbing skin fabrics 2 and 4, varies depending on the clothing or garments the fabric will be affixed. The greater the width of the climbing skin fabric that is affixed to the article of clothing, the greater the surface area provided for the fibers of the climbing skin fabrics to perform the function of impeding the displacement of the clothing. In some cases, it may be preferable to have a larger piece of climbing skin fabric to impede the displacement of clothing. For example, when the wearer is wearing clothing for more vigorous activity, it may be preferable to have larger pieces of climbing skin fabrics that have a greater width. In some embodiments, a strip of the climbing skin fabric (e.g. climbing skin fabrics 2 and 4 in FIG. 1) can extend completely or almost completely around the article of clothing to which it is attached. Nevertheless, intermittent or isolated strips of climbing skin fabrics may also be used, and any width of the fabric may be selected depending on how much is necessary. The width and/or length (or other dimension such as thickness) may also be based on the measurements and size of the article of clothing the fabric is attached to. The length and/or density of the fibers, such as fibers 22, disposed on climbing skin fabrics 2 and 4 may also vary depending on the clothing to which it will be affixed, and how vigorous the endeavor is anticipated to be. In some embodiments, the more vigorous the level of physical activity, the more densely packed and the longer fibers 22 may need to be. Climbing skin fabrics, such as climbing skin fabric 2 and 4, may be woven and/or adhesively attached to an article of clothing. Any type of weaving technique or adhesive technique may be used for attaching climbing skin fabrics, as described throughout, to an article of clothing. Those of ordinary skill in the art will appreciate that any alternative means of attachment may be used to attach climbing skin fabrics 2 and 4 to an articular of clothing, including, but not limited to using fasteners such as buttons, zippers, clips, or any other suitable fastener. Using fasteners and or removeable adhesives may be a few non-limiting ways to removeably attach or affix climbing skin fabrics 2 and 4 to a first article of clothing.

As further described below with respect to FIGS. 2-6, fibers 22 of climbing skin fabrics 2 and 4 may orient in an upward facing direction, a downward facing direction, a left facing direction, or a right facing direction (e.g. as described with respect to an alternative embodiment of keeping jacket 16 from unwanted displacement from glove 15 in FIG. 5). Nevertheless, the direction of the fibers may be angled in any direction without limitation to the above listed directions. In some embodiments, the direction of the fibers may be perpendicular to a surface of climbing skin fabrics 2 and 4 and thus point straight out from the surface of the climbing skin fabrics 2 and 4. Further, a wearer may select climbing skin fabrics 2 and 4 to fixedly attach to an article of clothing based on the particular orientation of fibers 22 of climbing skin fabrics 2 and 4.

Figure 2:
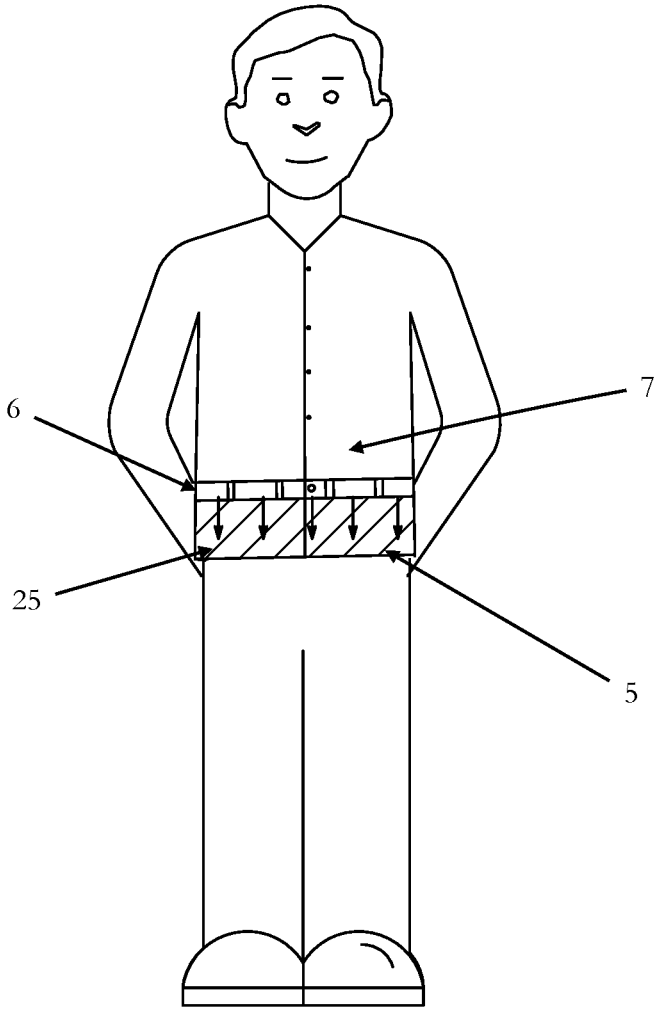
FIG. 2 is a pictorial illustration that depicts a climbing skin fabric attached to the inside of a pair of pants in accordance with an embodiment of the present description.

Turning to FIG. 2, FIG. 2 is a pictorial illustration of a system, according to one or more non-limiting embodiments, for preventing the upward movement of a first article of clothing, such as shirt 7, with respect to a second article of clothing, such as pair of pants 7. Those of ordinary skill in the art will appreciate that this system may be applied to different articles of clothing than that shown in FIG. 2.

In FIG. 2, shirt 7 has been tucked inside a pair of pants, such as pants 6. The system includes a strip of climbing skin fabric illustrated schematically as climbing skin fabric 25. Climbing skin 25 may be a climbing skin in accordance with climbing skins 2 and 4 in FIG. 1. Climbing skin fabric 25 may have fibers (e.g. fibers 22 shown in FIG. 1) generally oriented or facing in the downward direction, such as downward direction 5. As shown in FIG. 1, climbing skin fabric 25 is attached to the inside near the waistline area of pants 6.

The fibers of climbing skin fabric 25 may preferably be made from mohair, nylon, or a mohair-nylon blend, although any other combination or types of materials may be used instead. The pants 6 can be made of any suitable material typically used for making pants, including cloth, polyester, nylon, wool, cotton, and combinations thereof. Further, instead of a pair of pants, such as pants 6, climbing skin 25 may be used to impede the displacement of any type of clothing (e.g. skirts, shorts, and/or a kilt).

Climbing skin 25 can be woven (e.g. by sewing or other weaving technique) and/or or adhesively attached to the inside of the waistline of pants 6. Alternatively, climbing skin fabric 25 can be a continuous unitary structure that is fixedly attached to the inside of the waistline portion of pants 6. In certain embodiments, the climbing skin fabric 25 is attached completely or substantially completely around the inside of the waistline of pants 6. In other embodiments, the climbing skin fabric 25 is not a continuous single piece, but rather is a plurality of pieces attached at various locations on the inside of the waistline portion of pants 6. Further, climbing skin fabric 25 may be spaced equidistantly apart in a preferred embodiment when used as individual strips. Alternatively, any spacing and distance between each strip of climbing strip fabric 25 (when in this configuration) may be used.

As shown in FIG. 2, a method for preventing the upward movement of shirt 7 tucked inside pair of pants 6 using the system as described above is also illustrated. Prior to tucking shirt 7 inside pants 6, a single continuous piece of appropriate size and/or several strips of climbing skin 25 may be fixedly attached to an inside of the waistline portion of pants 6. Climbing skin 25 may be selected to have fibers (e.g. fibers 22) that point in the downward direction (e.g. direction 5). If the wearer of shirt 7 chooses to tuck shirt 7 into pants 6, the upward movement of shirt 7 may be prevented or impeded, because the pants 6 includes climbing skins 25 having its respective fibers pointing in the downward direction. As described above, when shirt 7 starts becoming untucked and/or moved out of place, a surface area of shirt 7 may encounter friction from the fibers disposed on climbing skin 25 and a grip that prevents or reduces the amount of displacement of shirt 7 in an upward direction. Thus, advantageously, shirt 7 may be prevented or impeded from becoming untucked. Further, it may be easier for the wearer (e.g. the man pictured in FIG. 1) to tuck shirt 7 into pants 6, because the downward facing fibers of climbing skin 25 may be configured to assist the fabric of shirt 7 to slide in the same downward direction as the fibers on climbing skin 25. As discussed above, climbing skin 25 may beneficially aid an article of clothing to glide or slide in the same direction as the fibers of climbing skin 25 and may impede unwanted movement in a direction that is opposite to the direction of the fibers of climbing skin 25. As shown in FIG. 2, shirt 7 is held securely in place by the fibers on the climbing skin fabric 25 resisting the pulling out of the shirt 7 from the pants 6.

Figure 3:
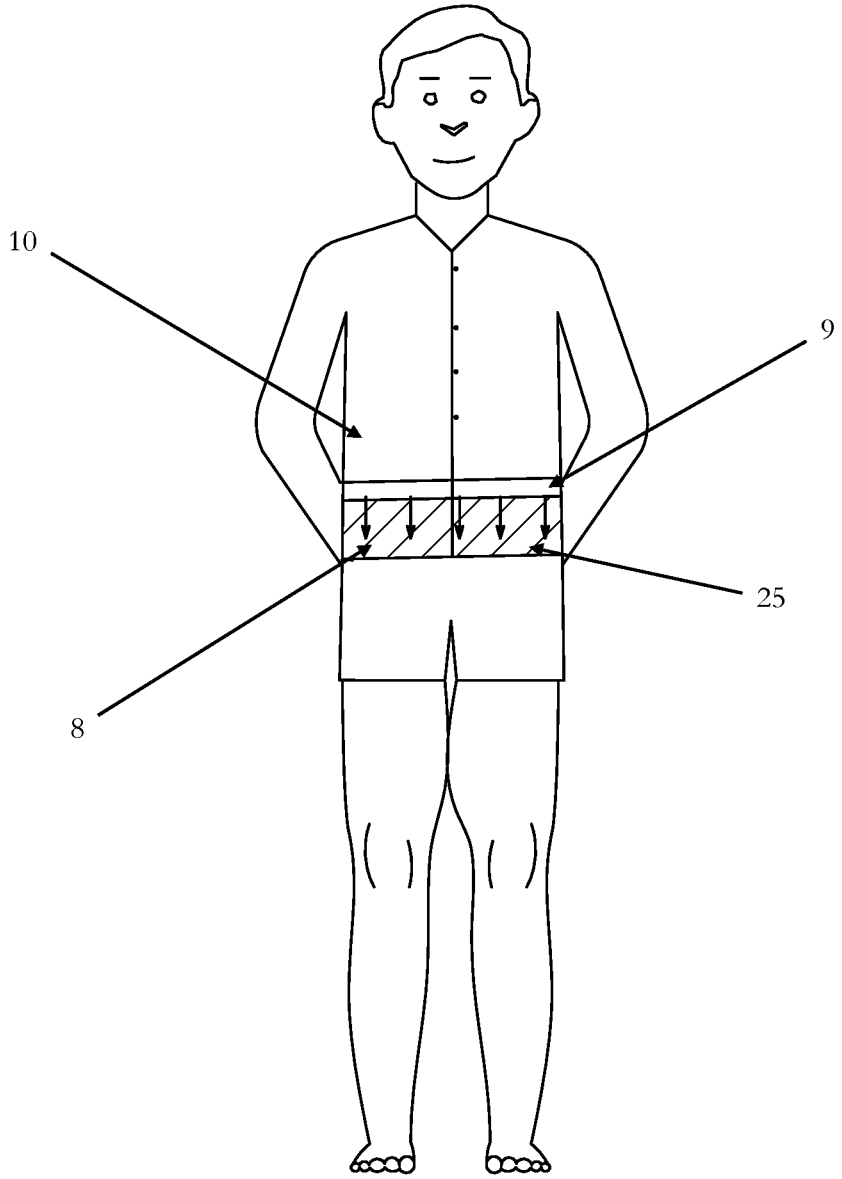
FIG. 3 is a pictorial illustration that depicts a climbing skin fabric attached to the outside of the waistband of a pair of underwear in accordance with an embodiment of the present description.

An alternative embodiment is shown in FIG. 3 for a system for preventing the upward movement of a first article of clothing with respect to a second article of clothing. In FIG. 3, climbing skin fabric 25 is attached to the outside of the waistband on a pair of underpants, such as underpants 9. FIG. 3 is in contrast with FIG. 2 in that the climbing skin fabric 25 may be applied to the outside of a first article of clothing (e.g. underpants 9) and still prevent the upward movement of a second article of clothing, such as shirt 10.

The system shown in FIG. 3 includes a strip of climbing skin fabric 25 with the fibers pointing or facing in the upward direction 8. The climbing skin fabric 25 is attached to the outside of the waistband on a pair of underpants 9. The fibers of climbing skin fabric 25 are preferably constructed from mohair, nylon, or a mohair-nylon blend. The underwear 9 can be made of any suitable material typically used, including, but not limited to, cotton, mesh, wool, and silk. In certain embodiments, underpants 9 can be any type of male or female underwear, including, but not limited to boxers, briefs, boxer-briefs, branded bikinis, thongs, G-string, or, jockstraps. The fibers of climbing skin fabric 25 can be woven or adhesively attached to the outside of the waistline of underpants 9. In some embodiments, climbing skin fabric 25 can be fixedly attached as a continuous, unitary structure around the outside of the waistline of underpants 9. Additionally, or alternatively, climbing skin 25 may be one or more strips of fabric fixedly attached (by any means known in the art) to the outside of the waistline of underpants 9. The strips of climbing skin fabric 25 may be separated either equidistantly or in any other arrangement as desired around the circumference of the outside of the waistline 9.

As shown in FIG. 3, an exemplary method for preventing the upward movement of a shirt 10 in contact with a pair of underpants 9 using the system as described above is also disclosed. The method includes the steps of providing a shirt 10 worn by the user. In alternative embodiments, a tank top or a blouse may be used instead of shirt 10. To impede upward movement of a shirt 10 when in contact with a pair of underpants 9, a process may include fixedly attaching climbing skin fabric 25 to the outside of the waistline portion of underpants 9. As noted above, climbing skin 25 may be a continuous, unitary piece or may be several strips spaced apart from one another around the circumference of the waistline of underpants 9. Next, a user may lay shirt 10 on top of the outside of the waistband of a pair of underwear 9 which has the climbing skin fabrics 25. Climbing skin fabrics 25 may be selected to have its fibers pointing in a downward direction 8. Beneficially, shirt 10 is held securely in place by virtue of an interior surface of shirt 10 being in contact with the fibers disposed on climbing skin fabrics 25, whereby the fibers resist the movement in an upward direction of shirt 10 which is in contact with underwear 9. As described above, the fibers of climbing skin fabric 25 may have grip and create friction that restricts movement of an article of clothing attempting to move against the orientation of the fibers of climbing skin 25.

Figure 4:
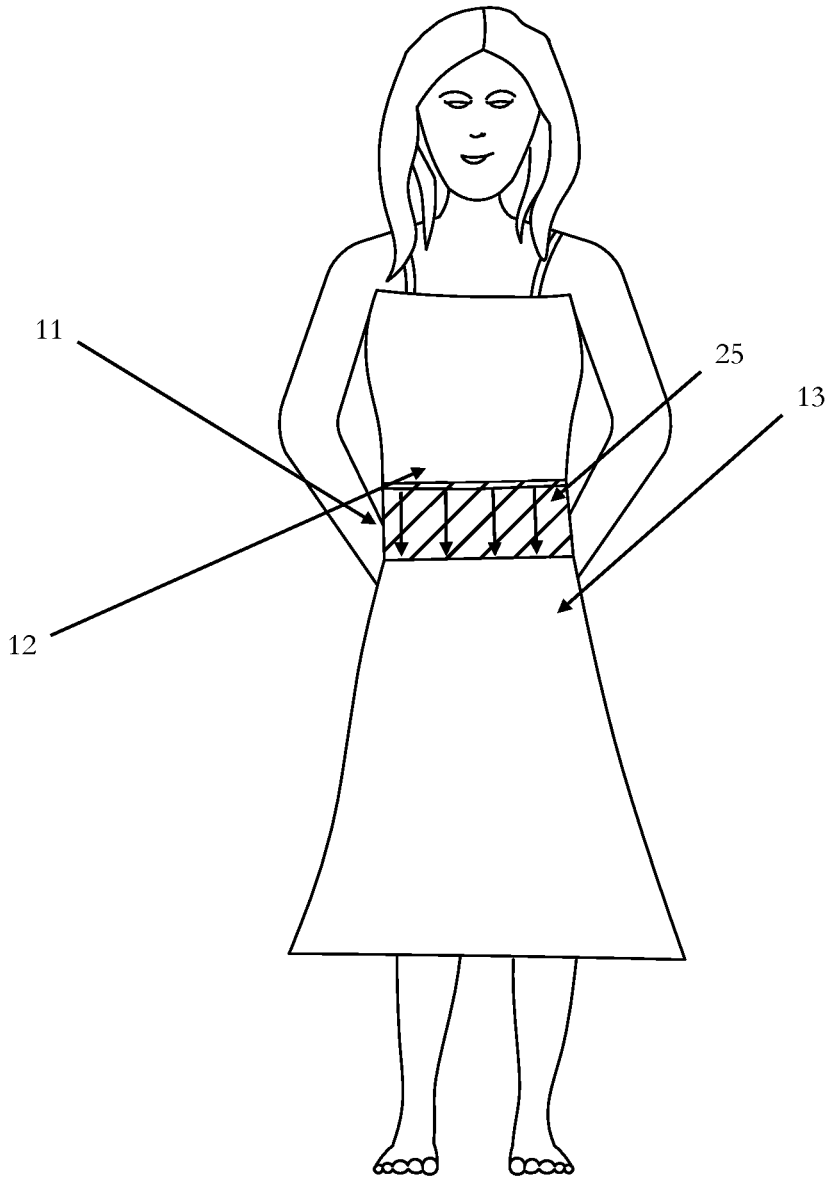
FIG. 4 is a pictorial illustration that depicts a climbing skin fabric attached to the outside of a women's slip in accordance with an embodiment of the present description.

An alternative embodiment is shown in FIG. 4 for a system for preventing the upward movement of a skirt 13 when in contact with the outside of a slip 12. FIG. 4 is an exemplary system that shows how the upward movement of a first article of clothing (such as skirt 13) may be impeded with respect to a second article of clothing (such as slip 12). The system may include a strip (or several strips in certain embodiments) of climbing skin fabric 25 with the fibers oriented in the downward direction 11. Climbing skin fabric 25 is attached to the outside of the slip 12. The fibers of climbing skin fabric 25 are preferably constructed from mohair, nylon, or a mohair-nylon blend. The slip 12 can be made of any suitable material typically used, including cotton, nylon, silk, and polyester. In certain embodiments the slip 12 can be a full slip or a half-slip.

Climbing skin fabric 25 can be woven or adhesively attached to the outside of the slip 12 or attached using any attachment means known in the art, including but not limited to using fasteners, such as, but not limited to, buttons, zippers, or clips. Alternatively, climbing skin fabric 25 can be a continuous unitary structure applied to the outside of slip 12. In certain embodiments, climbing skin fabric 25 is attached completely or substantially completely around the outside of the slip 12. In other embodiments, the climbing skin fabric 25 is attached to discontinuous parts of the slip 12. The strips of climbing skin fabric 25 can be separated in equally distant lengths around the circumference of the outside of the slip 12 or any other arrangement. In other alternative embodiments, the climbing skin fabric 25 can be attached to slip 12 with its fibers pointing in the upward direction to prevent skirts from moving downward to the ground. In yet other alternative embodiments, the fibers of climbing skin fabric 25 can be attached to the slip having fibers that point to the left or right relative to the front of the user to prevent a skirt's slit being moved to a less suitable or less desirable position.

As shown in FIG. 4, a method for preventing the upward movement of a skirt 13 when in contact with the outside of a slip 12 is illustrated. The method includes the steps of providing a skirt 13 worn by the user. In alternative embodiments, a dress may be used instead of a skirt, such as skirt 13. The method also includes the step of providing the system for preventing upward movement of a skirt 13 when in contact with a slip 12, including first attaching one or more strips of climbing skin fabric 25 to the outside of slip 12. Next, a user may put on slip 13, and then the user puts skirt 13 over slip 12. By this method, skirt 13 is held securely in place by the fibers on the climbing skin fabric 25 resisting the upward motion of skirt 13 that may start moving up the user's body (e.g. such as while the user is walking or in other type of motion).

Figure 5:
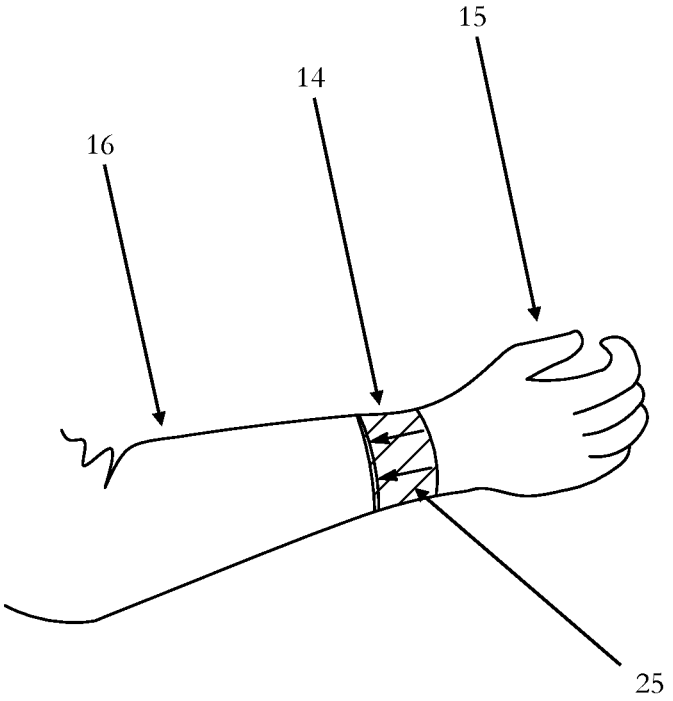
FIG. 5 is a pictorial illustration that depicts a climbing skin fabric attached to the outside of a glove in accordance with an embodiment of the present description.

Turning to FIG. 5, FIG. 5 is a pictorial illustration that illustrates a system and method for preventing the retreating movement of a jacket sleeve, such as jacket sleeve 16 when in contact with a glove, such as glove 15. The system includes a strip of climbing skin fabric 25, whereby the fibers facing in leftward direction 14 as shown in FIG. 5 or towards the back of the user's arm. The climbing skin fabric 25, as shown in FIG. 5 may be attached to the outside of the wrist section on glove 15. Glove 15 can be made of any suitable material typically used, including, but not limited to, cloth, knitted or felted wool, leather, rubber, latex, neoprene, and Kevlar. Any type of hand covering, such as a mitten, may be used instead of glove 15.

The following method, according to a non-limiting embodiment, may be used for preventing the retreating movement of a jacket 16 when in contact of with glove 15. The method may include the steps of providing a jacket 16. Alternatively, a long sleeve shirt, a hoodie, a parka, a sweater, or other long-sleeve top may be used instead of jacket 16. The method also includes the step of providing the system for preventing the retreating movement of a jacket 16 when in contact with a glove 15, as described above, including all of its elements. The method continues with the steps of the user putting on the glove 15. The user puts the jacket 16 over the glove 15 with the inside of the jacket in contact with the outside of the wrist part of the glove. The user can do this for both arms sequentially or simultaneously. The jacket 16 is held securely in place by the fibers on the climbing skin fabric 25 which are facing in the direction 14 resisting the retreating motion of the jacket 16. Accordingly, climbing skin fabric 25 may helpfully keep the ends of jacket 16, and more specifically an end of each arm portion of jacket 16, in place because one or more climbing skin fabrics 25 may have been previously fixedly attached to an outside of glove 15.

Figure 6:
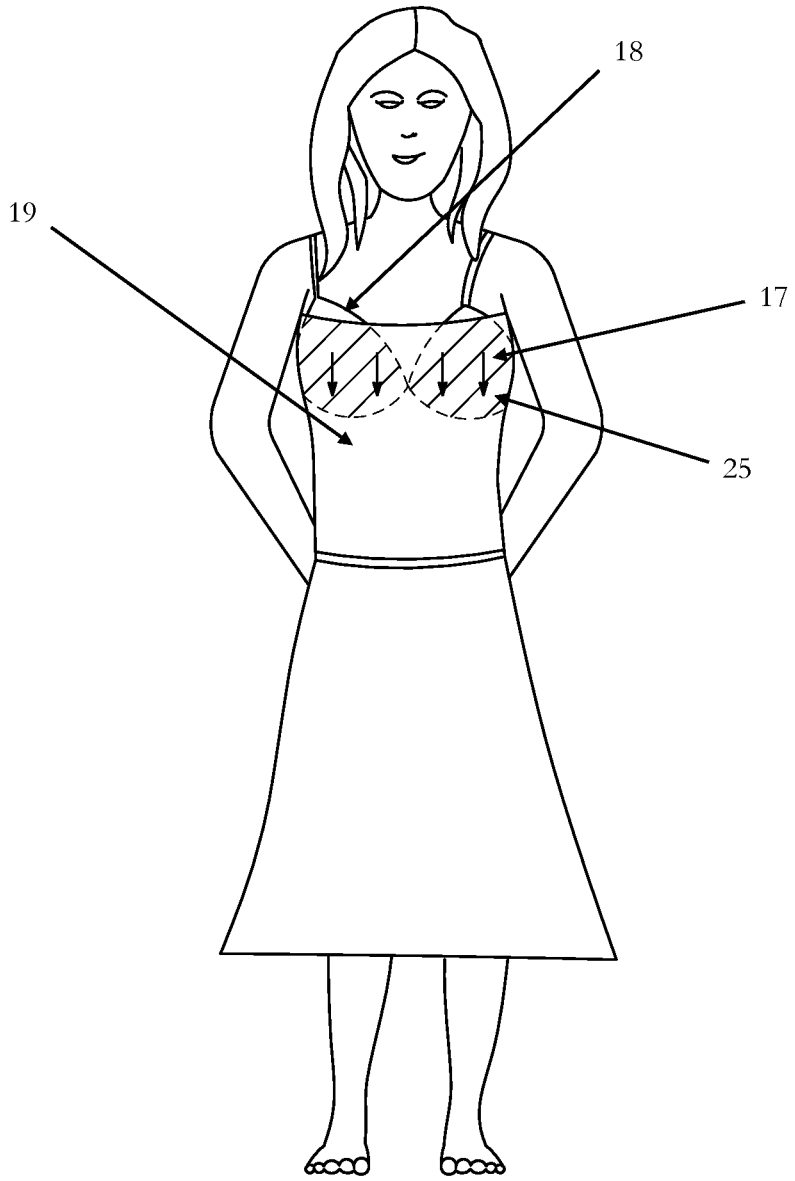
FIG. 6 is a pictorial illustration that depicts a climbing skin fabric attached to the outside of a bra cup in accordance with an embodiment of the present description.

FIG. 6 is a pictorial illustration for a system for preventing the upward movement of a dress 19 when in contact with a bra 18. The system includes a strip of climbing skin fabric 25 having its fibers facing the downward direction 17. The climbing skin fabric 25 is attached to the outside of the cup of bra 18. The fibers of the climbing skin fabric 25 are preferably constructed from mohair, nylon, or a mohair-nylon blend. The bra 18 can be made of any suitable material typically used, including but not limited to, linen, cotton broadcloth, Spandex, Latex, microfiber, satin, Jacquard, foam, mesh, and lace. Alternatively, a nipple cover, a bandeau, camisole, tank top, or chest wrapping may be used instead of bra 18. The climbing skin fabric 25 can be woven or adhesively attached (or attached through any other suitable mechanism including using fasteners) to the outside of one or both cups of bra 18. Just as described above, climbing skin fabric 25 may be a continuous, unitary piece or several pieces arranged on an outside of bra 18. Preferably, the climbing skin fabrics 25 can cover an equal amount of surface area on both cups of the bra 18, but in certain embodiments the surface area can be imbalanced depending on the user's desired look. In alternative embodiments, the fibers of climbing skin fabric 25 can be in another direction to prevent the movement of dress 19 against the fibers.

In one non-limiting method, the user may put on bra 18, whereby climbing skin fabric 25 with its fibers oriented in direction 17 are attached an outside surface of bra 18. The user may put on the dress over the bra 18 with the inside of the dress 19 in contact with the cup of the bra 18. Of course, a shirt, tank top, blouse, or any type of top may alternatively be worn instead of dress 19. Beneficially, dress 19 is held securely in place by the fibers on the climbing skin fabric 25 resisting the upward motion of the dress 19.

FIGS. 2-6 illustrate non-limiting examples of how climbing skin fabrics (e.g. climbing skin fabrics 2, 4, and 25) may be applied to either an inside or an outside surface of a first article of clothing to prevent unwanted movement of a second article of clothing with respect to the first article of clothing. It is noted that in some embodiments, a manufacturer, designed, or other creative entity may make and sell articles of clothing having such climbing skins in accordance with climbing skin 2, 4, and 25 already attached to articles of clothing. Alternatively, the wearer or user may be able to apply climbing skins 25 to an article of clothing as desired and when needed. Climbing skin fabrics 2, 4, and 25 can be cut or otherwise manipulated to be any suitable size desired by the user.

Further, climbing skins 2, 4, and 25 may be either permanently attached to an article of clothing or may be removeably attached such that climbing skins 2, 4, and 25 can be attached and removed more than once. Further, climbing skin fabrics, such as climbing skin fabrics 2, 4, and 25, are not limited to only one area of an article of clothing and can be located on multiple parts of clothing in any direction depending on the user's need or activity.

A method for selecting which climbing skin fabrics, such as climbing skin fabrics 25, to use to affix to either an outside surface or an inside surface of a first article of clothing may first include determining an orientation of unwanted movement of a second article of clothing. Further, the second article of clothing may be chosen because the second article of clothing may be the piece of clothing that tends to become easily displaced or have a tendency to move in an unwanted direction. For example, in FIG. 1, it would be undesirable and unwanted movement for shirt 7 (the second article of clothing) to move upwardly with respect to pants 6 (the first article of clothing). The wearer instead would prefer or shirt 7 to stay in place against pants 6 without moving in this unwanted way, thereby becoming displaced. Thus, the wearer (or another party) may select climbing skin fabrics 25 having the plurality of fibers that are biased in the opposite direction as the determined direction of unwanted movement of the shirt 7 (i.e. second article of clothing) with respect to pants 6 (i.e. first article of clothing).

Those of ordinary skill in the art will appreciate that, alternatively, a system and method for impeding movement of clothing may also include attaching the one or more sections of climbing skin fabrics 25 to any portion of a second article of clothing (e.g. shirt 7) instead of the first article of clothing (e.g. pants 6). In such a case, the particular orientation of the fibers would still be selected based on determining the direction of unwanted movement of the second article of clothing with respect to the first article of clothing. As noted above, the plurality of fibers (e.g. 22) on climbing skin fabrics 25 may be angled in any direction, and may be generally upward facing, downward facing, left facing, right facing, or any other desired arrangement.

Figure 7:
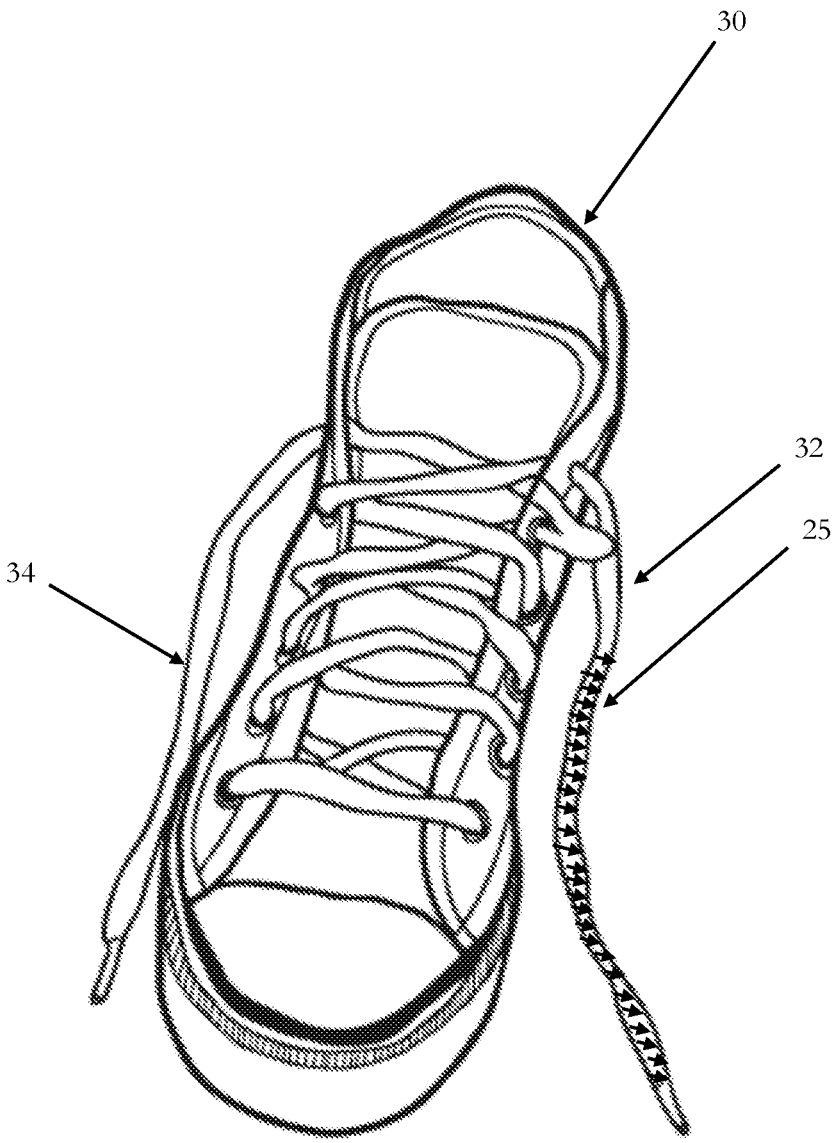
FIG. 7 is a pictorial illustration that depicts a climbing skin fabric attached to a first shoelace in accordance with an embodiment of the present description.

Turning to FIG. 7, FIG. 7 is a pictorial illustration of a system for impeding the displacement of shoelaces according to one or more non-limiting embodiments. It is an ongoing problem for shoelaces to easily become untied that the prior art has failed to properly address. Thus, the present description has discovered a means for impeding unwanted movement of a second shoelace, such as shoelace 34 with respect to a first shoelace, such as first shoelace 32, both of which are disposed on shoe 30. This system and method for impeding unwanted movement of shoelaces may be used with any type of shoe or any type of shoelaces as known in the art.

As shown in FIG. 7, climbing skin fabrics 25 may be attached (removeably or otherwise) to a portion of the string of first shoelace 32. Climbing skin fabrics 25 may include a plurality of fibers, in accordance with fibers 22 discussed above with respect to climbing skin fabrics 2 and 4 of FIG. 1. Climbing skin fabrics 25 may be formed as a single, unitary continuous piece that extends across a length of first shoelace 32 in one embodiment. In other embodiments, climbing skin fabrics 25 may be one or more strips or individualized pieces located anywhere along the length of first shoelace 32. Further, in some embodiments, climbing skin fabrics 25 may be disposed on only one shoelace, such as first shoelace 32 or second shoelace 34, or on both first shoelace 32 and on second shoelace 34. FIG. 7 is non-limiting and in other embodiments, climbing skin fabrics may be positioned in different directions, be of different length occupy, more or less area of the first and/or second shoelace.

A method of impeding unwanted movement of the second shoelace 34 with respect to first shoelace 32 may include affixing climbing skin fabrics 25 to first shoelace 32, and then tying the shoelaces (i.e. 32 and 34) together using any tying technique preferred by the wearer of shoe 30. When a portion of the second shoelace 34 comes into contact with a portion of the first shoelace 32, the second shoelace 34 is met with a higher coefficient of friction while moving against the particular orientation of the plurality of fibers disposed on the climbing skin fabrics 25. Additionally, second shoelace 34 is met with a lower coefficient of friction when in contact with the first portion of the string portion on the shoelace while moving in the particular orientation of the plurality of fibers disposed on the climbing skin fabrics 25. Thus, the unwanted movement of second shoelace 34 with respect to first shoelace 32 may be minimized or prevented altogether. In one or more embodiments, climbing skin fabrics 25 may be attached or already built into shoelace strings to keep them from being untied.

It is clear that many applications and uses have been described above with respect to one or more embodiments for a system and method for impeding the displacement of an article of clothing. However, other applications and uses are also within the scope and spirit of the one or more embodiments of the present description.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the above claims.

The invention claimed is:

1. A system for impeding the displacement of clothing, the system comprising:

a first article of clothing;

a second article of clothing;

one or more sections of climbing skin fabrics, the one or more sections of climbing skin fabrics having a plurality of fibers disposed on an outer surface of the one or more sections of climbing skin fabrics, wherein the plurality of fibers have a particular orientation selected to oppose unwanted movement in a first direction and allow movement in a second direction opposite of the first direction, wherein the one or more sections of climbing skin fabrics are configured to affix to the first article of clothing, and wherein the second article of clothing is configured to be in contact with the plurality of fibers of the one or more sections of climbing skin fabrics, wherein the plurality of fibers rise up against the second article of clothing when the second article of clothing is moving in the first direction and lie down when the second article of clothing is moving in the second direction.

2. The system of claim 1, wherein the one or more sections of climbing skin fabrics are configured to be removeably attached to the first article of clothing.

3. The system of claim 1, wherein the plurality of fibers disposed on the one or more sections of climbing skin fabrics are configured to be primarily oriented at an angle in downward facing direction, an upward facing direction, a left facing direction, a right facing direction, or any other direction needed to oppose the unwanted movement of the second article of clothing.

4. The system of claim 1, wherein the one or more sections of the climbing skin fabrics are configured to be affixed to an inside surface or an outside surface of the first article of clothing.

5. The system of claim 1, wherein the climbing skin fabrics are configured to be affixed to the first article of clothing using adhesives or using fasteners, or a combination thereof.

6. The system of claim 1, wherein the climbing skin fabrics are affixable to the first article of clothing by sewing the climbing skin fabrics to the first article of clothing.

7. The system of claim 1, wherein the plurality of fibers comprises nylon.

8. The system of claim 1, wherein the plurality of fibers comprise mohair.

9. The system of claim 1, wherein the plurality of fibers comprises a mohair-nylon mixture.

10. A method for impeding a displacement of clothing, said method comprising:

providing a method for impeding displacement of a first article of clothing with respect to a second article of clothing, further comprising:

affixing the first article of clothing, with one or more pieces of climbing skin fabrics, wherein the one or more sections of the climbing skin fabrics have a plurality of fibers on an outer surface of the one or more sections of the climbing skin fabrics, the plurality of fibers having a particular orientation; and positioning the second article of clothing in a desired position with respect to the first article of clothing on a wearer's body such that the second article of clothing is in contact with the one or more sections of the climbing skin fabrics, wherein the second article of clothing is met with a higher coefficient of friction while moving in a direction against the particular orientation of the plurality of fibers and a lower coefficient of friction while moving in a same direction as the particular orientation of the plurality of fibers, thereby securing the first article of clothing and second article in place as well as facilitating movement of the second article of clothing back in place.

11. The method of claim 10, wherein the one or more sections of climbing skin fabrics are affixed to either an outside surface or an inside surface of the first article of clothing.

12. The method of claim 10, wherein the one or more sections of climbing skin fabrics are removeably affixed to the first article of clothing.

13. The method of claim 10, further comprising, selecting the one or more sections of climbing skin fabrics to affix to the first article of clothing based on the particular orientation of the plurality of fibers.

14. The method of claim 10, further comprising, determining a direction of unwanted movement of the second article of clothing.

15. The method of claim 14, further comprising, selecting the particular orientation of the plurality of fibers to oppose the unwanted movement of the second article of clothing, wherein the particular orientation of the plurality of fibers is biased in an opposite direction of the unwanted movement of the second article of clothing.

16. The method of claim 10, wherein the particular orientation of the plurality of fibers is angled in a primarily upward facing direction, downward facing direction, left facing direction, right facing direction, or any direction needed to oppose unwanted movement of the second article of clothing.

17. The method of claim 10, wherein first article of clothing is a pair of pants and the second article of clothing is a shirt or the first article of clothing is a glove and the second article of clothing is a jacket.

18. The method of claim 10, wherein the first article of clothing is a pair of underpants and the second article of clothing is a shirt.

19. The method of claim 10, wherein the first article of clothing is a slip and the second article of clothing is a skirt.

* * * * *